United States Patent [19]

Mori et al.

[11] 4,437,909

[45] Mar. 20, 1984

[54] PROCESS FOR PRODUCING A GRAIN-ORIENTED SILICON STEEL SHEET OR STRIP HAVING EXCELLENT MAGNETIC PROPERTIES

[75] Inventors: Kensuke Mori, Himeji; Hiromi Matsumoto, Kitakyushu; Yozo Suga, Kitakyushu; Tadashi Nakayama, Kitakyushu; Fumio Matsumoto, Kawasaki, all of Japan

[73] Assignee: Nippon Steel Corporation, Tokyo, Japan

[21] Appl. No.: 381,878

[22] Filed: May 25, 1982

[30] Foreign Application Priority Data

May 30, 1981 [JP] Japan ..... 56-83072

[51] Int. Cl.[3] ..... H01F 1/04

[52] U.S. Cl. ..... 148/111; 148/110

[58] Field of Search ..... 148/111, 112, 110

[56] References Cited

U.S. PATENT DOCUMENTS

| | | | |
|---|---|---|---|
| 1,898,061 | 2/1933 | Otte | 148/111 |
| 3,640,780 | 2/1972 | Stanley | 148/111 |
| 3,990,923 | 11/1976 | Takashina et al. | 148/111 |
| 4,171,994 | 10/1979 | Miller | 148/111 |
| 4,339,287 | 7/1982 | Matsumoto et al. | 148/111 |

FOREIGN PATENT DOCUMENTS

| | | | |
|---|---|---|---|
| 19289 | 11/1980 | European Pat. Off. . | |
| 37-1568 | 5/1962 | Japan . | |
| 48-53919 | 7/1973 | Japan . | |
| 50-37009 | 12/1973 | Japan . | |
| 55-64908 | 5/1980 | Japan . | |
| 55-152123 | 11/1980 | Japan . | |
| 656679 | 4/1979 | U.S.S.R. | 148/112 |

*Primary Examiner*—John P. Sheehan

*Attorney, Agent, or Firm*—Kenyon & Kenyon

[57] ABSTRACT

The present invention relates to a process for producing a grain-oriented silicon steel sheet or strip, wherein the crystals of the steel sheet or strip have an orientation of {110}<001> and, further, the steel is easily magnetized in the rolling direction.

Since the slab-heating temperature for a grain-oriented silicon steel is considerably higher than that for low carbon steel grades, coarsening of the crystal grains is likely to occur during heating, and the coarse crystal grains are elongated during hot-rolling in the rolling direction and remain in the hot-rolled steel sheet as portions of the grain-oriented silicon steel strip or sheet, where secondary recrystallization becomes incomplete, or as so-called streaks.

It is an object of the present invention to provide a novel hot-rolling technique capable of preventing the generation of streaks and capable of enhancing the magnetic flux density of the final product in terms of the $B_8$ value even in a case where the tendency of streaks to form is small.

The present invention is characterized in that during hot-rolling a silicon steel slap is subjected to at least one pass in which the axial lines of the top working roll and the bottom working roll are non parallel, and as a result of these working rolls being non parallel, the grain-oriented electromagnetic steel sheet or strip has no streaks and has a high magnetic flux density.

8 Claims, 2 Drawing Figures

PROCESS FOR PRODUCING A GRAIN-ORIENTED SILICON STEEL SHEET OR STRIP HAVING EXCELLENT MAGNETIC PROPERTIES

The present invention relates to a process for producing a grain-oriented silicon steel sheet or strip, wherein the crystals of the steel sheet or strip have an orientation of {110} <001> and, further, the steel is easily magnetized in the rolling direction.

As is well known, in the production of a grain-oriented silicon steel sheet or strip, a silicon steel slab is hot-rolled and is subjected to at least one cold-rolling operation so as to reduce the thickness of the sheet or strip. The hot-rolled or cold-rolled sheet or strip is subjected to annealing at least once, if necessary, and is then subjected to decarburization annealing and final annealing.

In final annealing, the crystal grains of the steel sheet or strip are caused to coarsely grow so that the selective growth of the primary recrystallized grains having a {110} <001> orientation takes place and thus the crystal grains of the final product have a {110} <001> orientation. Such crystal grain growth is referred to as secondary recrystallization. In order for secondary recrystallization to take place, two things are necessary. First, the dispersion phases of the precipitates must be appropriate before a steel sheet or strip is subjected to final annealing. Second, prior to final annealing, the steel sheet or strip must have an appropriate metallographic structure in light of both the grain diameter and crystal texture.

In order to provide a grain-oriented silicon steel sheet or strip having a high magnetic flux density, the crystal grains should have a high degree of texture having an orientation of {110} <001>, resulting in enhancement of the magnetic flux density usually in terms of the $B_8$ value, that is, the magnetic flux density under a magnetizing force of 800 A/m.

So that precipitates having the above-mentioned appropriate dispersion phases can be attained, steel slabs are heated to a high temperature prior to hot-rolling, for example, to 1300° C. or higher, so as to satisfactorily dissolve the components of the inhibitors, such as Mn, Al, N and S, into a solid solution, and, subsequently, the inhibitors are precipitated in succeeding steps, including hot-rolling. Since the slab-heating temperature for a grain-oriented silicon steel is considerably higher than that for low carbon steel grades, coarsening of the crystal grains is likely to occur during heating, and the coarse crystal grains are elongated during hot-rolling in the rolling direction and remain in the hot-rolled steel sheet as portions of the grain-oriented silicon steel strip or sheet, where secondary recrystallization becomes incomplete, or as so-called streaks, as pointed out in Japanese Laid-open Patent Application No. 48-53919 (1973).

In recent years, the conventional ingot making method has been replaced by the continuous casting method, in which a columnar structure is formed in the slab due to rapid-cooling solidifications, i.e., peculiar solidification. When slabs having a columnar structure are heated to a high temperature, abnormal coarsening of the grains is likely to occur, as compared with slabs produced by means of the conventional ingot making and slabbing methods, due to the columnar structure. Consequently, the streaks described hereinabove are formed due to coarsening of the grains. In addition, in a case where the carbon content of a steel slab is low, streaks are liable to be formed. In order to prevent the formation of streaks, a double hot-rolling process, in which a steel slab is subjected to hot-rolling twice so as to obtain a hot-rolled sheet or strip, is proposed in Japanese Laid-open Patent Application No. 48-53919 (1973) regarding the production of a regular grain-oriented electromagnetic steel sheet and in Japanese Published Patent Application No. 50-37009 (1975) regarding a grain-oriented electromagnetic steel sheet having a high magnetic flux density. The proposed double hot-rolling process is uneconomical due to the fact that hot-rolling of a steel slab is carried out twice.

Japanese Laid-open Patent Application No. 55-152123 (1980) and European Patent Publication No. 0,019,289 disclose that hot-rolling creating a plastic flow, which is asymmetric in the upper and lower regions of a steel slab as seen in the cross section of the steel slab in the rolling direction, is effective for preventing the generation of streaks. This is true in that the disclosed type of hot-rolling does effectively prevent the generation of streaks to a considerable extent. However, it is not disclosed in the above-mentioned Japanese Laid-open Patent Application and European Patent Publication that in a case where streaks are unlikely to form, the magnetic flux density of the final product is enhanced. It is, however, desirable for the users of a grain-oriented electromagnetic steel sheet that, irregardless of whether or not streaks are formed in the production process, the magnetic flux density of the final product be so high that transformers or the like can be small in size. Contrary to this, the producers of a grain-oriented electromagnetic steel sheet must employ a technique capable of preventing the generation of streaks and a technique capable of enhancing the magnetic flux density of the final product even if there is no tendency toward the formation of streaks.

Again, regarding Japanese Laid-open Patent Application No. 55-152123 (1980) and European Patent Application No. 0,019,289, the problem of decreasing the thickness of the final product from the conventional 0.30 mm to 0.28 mm or less is not specifically disclosed. There has been a recent tendency to decrease the thickness of the final product so as to decrease the watt loss, but such a decrease is one of the factors which contributes to increasing the tendency of streaks to form. When a continuously cast steel slab having a low carbon content is subjected to hot-rolling and cold-rolling so as to produce a steel sheet or strip having a thickness of 0.28 mm or less, it is very likely that even if the known type of hot-rolling producing an asymmetric plastic flow is carried out, streaks will appear in the final product.

It is an object of the present invention to provide a process for producing a grain-oriented electromagnetic steel sheet or strip based on a novel hot-rolling technique capable of preventing the generation of streaks and capable of enhancing the magnetic flux density of the final product in terms of the $B_8$ value even in a case where the tendency of streaks to form is small.

It is also an object of the present invention to prevent the formation of streaks in a final product having a sheet thickness of 0.28 mm or less.

In accordance with the objects of the present invention, there is provided a process for producing a grain-oriented silicon steel strip or sheet wherein a silicon steel slab containing from 2.0 to 4.5% by weight of silicon, and not more than 0.080% by weight of carbon is subjected to hot-rolling and cold-rolling, the cold-rolling being carried out in either one step or two steps, characterized in that during hot-rolling said silicon steel slab is subjected to at least one pass in which the axial lines of the top working roll and the bottom working roll are non parallel, as a result of these working rolls being non parallel, the grain-oriented electromagnetic steel sheet or strip has no streaks and has a high magnetic flux density.

In an embodiment of the present invention, during a pass or passes identical to or different from the pass(es) in which the top working roll and the bottom working roll have said non parallel axial lines, the top working roll and the bottom working roll have different circumferential speeds Vu and Ve, respectively. The circumferential speed (Vu) of the top working roll can be greater than the circumferential speed (Ve) of the bottom working roll, and the relative circumferential speed $$V_R = Vu/Ve$$

can be at least 1.05. Alternatively, the circumferential speed (Ve) of the bottom working roll can be greater than the circumferential speed (Vu) of the top working roll, and the relative circumferential speed $$V_R = Ve/Vu$$

can be at least 1.05.

The present invention is explained in detail hereinafter.

Figure 1:
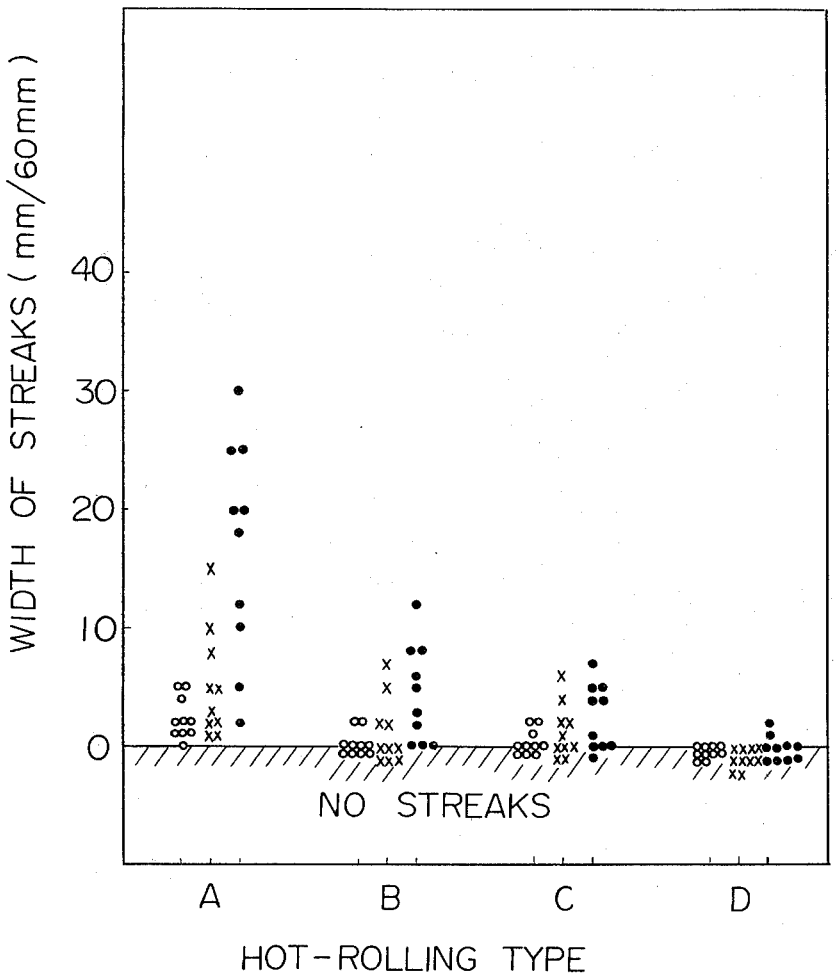
FIG. 1 is a graph of streak width as a function of the type of hot rolling.

The starting material of the process according to the present invention contains from 2.0 to 4.5% by weight of silicon and not more than 0.080% of carbon, as well as an appropriate amount of at least one element capable of forming with dispersion phases of the precipitates. The remainder of the starting material is iron and unavoidable impurities. When the silicon content exceeds 4.5%, cold-rolling becomes disadvantageously difficult so that rupture of a steel strip is likely to occur during cold-rolling. On the other hand, when the silicon content is less than 2.0%, a single ferrite phase cannot be formed during final annealing so as to achieve secondary recrystallization. At least one element capable of forming the dispersion phases of the precipitates is indispensable since the dispersion phases of the precipitates are indispensable for realizing secondary recrystallization during final annealing and for thus enhancing the degree of texture having an orientation of {110} <001>. As the compounds capable of forming the dispersion phases of the precipitates, such compounds as MnS, AlN, and a combination MnS and AlN are conventionally used and can also be used in the present invention. In addition, any compounds such as MnSe, VN, TiN, and the like capable of forming the dispersion phases of the precipitates and of inhibiting secondary recrystallization can be used in the present invention. Intentionally, an additional element or elements, such as copper (Cu), nickel (Ni), chromium (Cr), molybdenum (Mo), antimony (Sb), phosphours (P), and other solute atoms in the matrix of silicon steels are frequently used in a grain-oriented electromagnetic steel sheet or strip. The hot-rolling of the present invention is also effective for preventing the formation of streaks and for enhancing the magnetic flux density regarding silicon steels containing solute atoms.

In a preferable embodiment of the present invention, the contents of the elements capable of forming the dispersion phases of the precipitates are as follows, although the present invention is not at all restricted by these contents: from 0.01 to 0.05% acid-soluble aluminum; from 0.05 to 0.20% manganese; from 0.005 to 0.040% sulfur; and from 0.0030 to 0.10% nitrogen.

Molten silicon steels containing the elements as described above can be obtained by means of any refining method using a converter, an electric furnace, or an open hearth furnace. A silicon steel slab can be obtained by means of a continuous casting method or a conventional ingot making method. The present invention can specifically be effectively applied to a silicon steel slab obtained by means of a continuous casting method since streaks are liable to form in a silicon steel slab which has been continuously cast. However, the present invention can also be effectively applied to a silicon steel slab obtained by means of a conventional ingot making method since streaks are sometimes formed in such a slab. In short, the hot-rolling of the present invention is effective for stabilizing secondary recrystallization since it prevents the formation of streaks. Also, it has been discovered by the present inventors that even in a case where normal secondary recrystallization without the formation of streaks takes place, the hot-rolling of the present invention can be effectively applied to a silicon steel slab produced by means of any casting method, thereby enhancing the degree of texture having an orientation of {110} <001> and the magnetic flux density in terms of the $B_8$ value of the final product.

A silicon steel slab obtained by means of any casting method is usually heated and then hot-rolled so that a steel sheet or strip is obtained. Recently, in order to decrease the heat energy consumed during hot-rolling, direct hot-rolling, in which a silicon steel slab is directly hot-rolled without undergoing cooling after either continuous casting of or rough-rolling of an ingot, has become popular. Such direct hot-rolling may be used in the present invention. In the present invention a hot-rolled strip is annealed if necessary. For example, it is subjected to annealing at a temperature of 1200° C. or lower for a period of 30 seconds or more and then is cold-rolled to a final thickness. Cold-rolling is carried out in either one step or two steps. The hot-rolled strip having a final thickness is subjected to decarburization annealing, followed by the application of an annealing separator, and to then final high-temperature annealing. The conditions of decarburization annealing and final high-temperature annealing are known from U.S. Pat. No. 3,990,923, issued to Takanashi et al and assigned to Nippon Steel Corporation.

The crux of the present invention results in an improvement in hot-rolling, which is one of the steps involved in the preduction of a grain-oriented electromagnetic steel sheet or strip. Generally, the hot-rolling of a silicon steel slab is carried out by means of rough-rolling and finish-rolling in the case of a thick silicon steel slab having a thickness of from 150 to 300 mm or by means of finish-rolling only in the case of a thin silicon steel slab having a thickness of from 30 to 100 mm. Both rough-rolling and finish-rolling involve a plurality of passes. That is, a thick silicon steel slab is reduced to an intermediate thickness by means of rough-rolling and is subsequently reduced to a fianl thickness by means of finish-rolling, and in the case of a thin silicon steel slab, rough-rolling is not carried out. Rough-rolling is usually carried out at a temperature higher than 1200° C. and finish-rolling is usually carried out at a temperature ranging from 950° to 1250° C. In conventional hot-rolling the top working roll and the bottom working roll in the case of each pass have axial lines which are completely parallel as seen in a horizontal plane. Contrary to this, during hot-rolling according to the present invention, a silicon steel slab is rough-rolled and/or finish-rolled in at least one pass in which the axial lines of the top working roll and the bottom working roll are non parallel, as stated above, such a type of hot-rolling is referred to as a roll-cross type of hot-rolling and is known, for example, in Japanese Published Patent Application No. 37-1568 (1962) and Japanese Laid-open Patent Application No. 55-64908 (1980). However, the known roll-cross type of hot-rolling aims, by means of a crosswise arrangement of the top working roll and the bottom working roll, to concavely deform the middle portion of a steel slab, which portion is convexly formed in conventional hot-rolling, so as to prevent the steel sheet or strip from having a nonuniform thickness respect to the width or a greater thickness at the middle portion than at the end portions. The present inventors made a study as to how the roll-cross type of hot-rolling can exert an influence on the material of silicon steels and discovered that when the roll-cross type of hot-rolling is employed in the hot-rolling of a silicon steel slab, advantageously, the magnetic flux density is enhanced and no streaks are formed. The reason why the roll-cross type of hot-rolling results in these advantages is not clear. Presumably, since a plastic strain in a direction perpendicular to the rolling direction is induced due to a characteristic of the roll-cross type of hot-rolling, a hot-rolled strip having an appropriate metallographic structure is obtained.

The magnetic properties of the final product can be enhanced more by increasing the intersection angle of the two axial lines as seen in a horizontal plane. However, when said intersection angle exceeds approximately 3°, the rolling of a silicon steel slab becomes difficult. Therefore, an intersection angle exceeding 3° is unadvisable when the hot-rolling operation is carried out. From the point of view of both enhancement of the magnetic properties and the hot-rolling operation, said intersection angle is preferably approximately 1.0°.

The temperature of a silicon steel slab when rolled by means of the roll-cross type of hot-rolling is preferably in the range of from 1160° to 850° C. where recrystallization is likely to occur during hot-rolling. In this case, the silicon steel slab is subjected to the roll-cross type of hot-rolling in at least one pass and may be carried out in a single step, although the carrying out of a plurality of said passes is more effective for enhacing the magnetic properties of the final product. The number of passes carried out in the roll-cross type of hot-rolling should be determined in accordance with the practice of hot-rolling.

When the roll-cross type of hot-rolling is combined during an identical pass or different pass with hot-rolling in which the silicon steel slab is passed between the top working roll and the bottom working roll, both working rolls having different circumferential speeds, the generation of streak, especially those in a thin final product having a sheet thickness of 0.28 mm or less, can be advantageously prevented.

The preferred embodiments of the present invention and conventional processes are now explained.

Silicon steel slabs containing 0.040%C, 3.10%Si, 0.07%Mn, 0.030%S, 0.035% acid-soluble aluminum; and 0.008% total N and being 40 mm thick, 200 mm long, and 100 mm wide are heated to 1400° C. and are subjected to one of the following types of hot-rolling, each type being carried out in 3 passes.

A. A conventional non-roll-cross type of hot-rolling is carried out and the circumferential speeds of the top working roll and the bottom working roll are the same.

B. A non-roll-cross type of hot-rolling is carried out and the number of rotations of the top working roll relatively differed from that of the bottom working roll by 25%.

C. A roll-cross-type of hot-rolling is carried out by crosswisely arranging the axial lines of the top working roll and the bottom working roll in the case of each pass at an intersection angle of 1° as seen in a horizontal plane. The number of rotation of the top working roll and the bottom working roll is the same.

D. A roll-cross and unequal circumeferential-speed type of hot-rolling is carried out by crosswisely arranging the axial lines of the top working roll and the bottom working roll in the case of each pass at an intersection angle of 1° as seen in a horizontal plane and by differentiating the number of rotations of the top working roll from that of the bottom working roll by a value of 25%.

In the experiments using the above explained types of the hot rolling, the results as given in FIG. 1 were obtained. In these experiments hot-rolled sheets 2.2 mm thick were formed by hot-rolling silicon steels in 3 passes. The temperature of the silicon steels was approximately 1320° C. during the first pass, approximately 1110° C. during the second pass, and approximately 830° C. during the third pass. The induction during each pass was virtually the same. The resultant hot-rolled sheets were precipitation annealed by heating them to 1120° C. and holding the temperature for 2 minutes. The hot-rolled and precipitation annealed sheets were cold-rolled in ten passes so as to obtain cold-rolled sheets 0.30 mm, 0.28 mm, or 0.25 mm in thickness. Heat was applied to the silicon steels being rolled between the two cold-rolling stands so that the silicon steels were heat-treated at 150° C. for 3 minutes. The resultant cold-rolled sheets were then decarburization annealed at a temperature of 840° C. for 4 minutes in a wet hydrogen gas. Next, magnesium oxide was applied to the sheets, which were then dried. Then final annealing was carried out at 1200° C. for 20 hours.

The degree to which streaks were generated in terms of the width of the streaks was calculated on the basis of the 60 mm length of the resultant grain-oriented electromagnetic steel sheet is shown in FIG. 1. In FIG. 1, the symbols O, X, and • indicate said sheets having a thickness of 0.30 mm, 0.28 mm, and 0.25 mm, respectively. As is apparent from FIG. 1, the roll-cross types of hot-rolling C and D of the present invention can considerably reduce the degree to which streaks are generated as compared with conventional hot-rolling A. Particularly, regarding the 0.25 mm thick grain-oriented electromagnetic steel sheets, the degree to which streaks were generated was remarkably reduced due to a combination of the roll-cross type of hot-rolling and the unequal circumferential-speed type of hot-rolling.

In another experiment, an attempt was made to verify how the roll-cross type of hot-rolling is effective for enhancing the magnetic flux density in terms of the $B_8$ value in a case where no streaks are formed. In this experiment, twenty silicon steels containing 0.060%C, 2.90%, Si, 0.08% Mn, 0.030% S, 0.028% acid-soluble aluminium, and 0.009% total N were heated to 1330° C. and then ten silicon steels were, respectively, subjected to the following types of hot-rolling, each type being carried out in 3 passes.

E. A conventional non-roll-cross type of hot-rolling was carried out and the circumferential speeds of the top working roll and the bottom working roll were the same.

F. A roll-cross type of hot-rolling was carried out by crosswisely arranging the axial lines of the top working roll and the bottom working roll in the case of each pass at an intersection angle of 1.5° as seen in a horizontal plane. The number of rotation of the top working roll and the bottom working roll was the same.

Hot-rolled sheets 2.2 mm thick were formed by hot-rolling silicon steels in 3 passes. The temperature of the silicon steels was approximately 1280° C. during the first pass, approximately 1070° C. during the second pass, and approximately 790° C. during the third pass. The reduction during each pass was virtually the same. The resultant hot-rolled sheets were precipitation annealed by heating them to 1120° C. and holding the temperature for 2 minutes. The hot-rolled and precipitation annealed sheets were cold-rolled in ten passes so as to obtain cold-rolled sheets having a thickness of 0.30 mm. Heat was applied to the silicon steels being rolled between the two cold-rolling stands so that the silicon steels were heat-treated at 200° C. for 3 minutes. The resultant cold-rolled sheets were then decarburization annealed at a temperature of 840° C. for 4 minutes to a wet hydrogen gas. Next, magnesium oxide was applied to the sheets, which were then dried. Then final annealing was carried out at 1200° C. for 20 hours.

Figure 2:
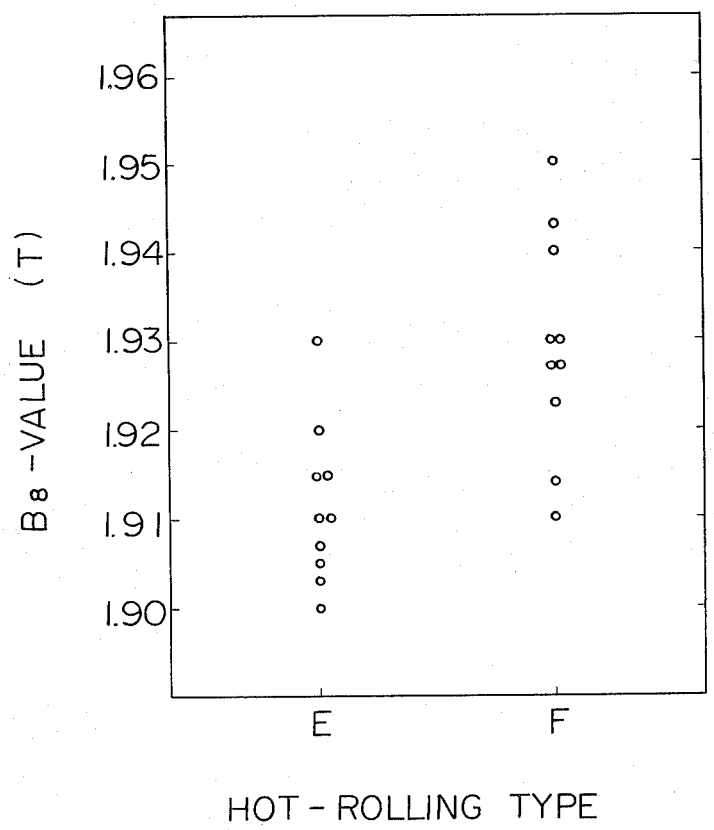
FIG. 2 is a graph of $B_8$ as a function of the type of hot rolling.

The $B_8$ values of the final products are shown in FIG. 2. As is apparent from FIG. 2, the $B_8$ values obtained by means of a process including the F type of hot-rolling (the roll-cross type of hot-rolling) are superior to those obtained by means of the conventional type of hot-rolling. It could therefore be verified that the roll-cross type of hot-rolling which has conventionally been used to improve the sheet shape of a hot-rolled steel strip can enhance the magnetic flux density of a grain-oriented electromagnetic sheet.

The present invention is now explained by way of examples.

EXAMPLE 1

A silicon steel containing 0.050% C, 3.10% Si, 0.07% Mn, 0.030% S, 0.030% acid-soluble aluminum, and 0.007% total N was heated to 1420° C. and then was subjected to the following types of hot-rolling, each type being carried out in 3 passes so that a 2.2 mm thick hot-rolled sheet was produced.

G. A roll-cross type of hot-rolling was carried out by crosswisely arranging the axial lines of the top working roll and the bottom working roll during the second pass at an intersection angle of 1.5° as seen in a horizontal plane and a conventional type of hot-rolling was carried out during the first and third passes.

The temperature of the silicon steel was approximately 1130° C. during the second pass. The resultant hot-rolled sheet was precipitation annealed by heating it to 1120° C. and holding the temperature for 2 minutes. The hot-rolled and precipitation annealed sheet was cold-rolled in ten passes so as to obtain a cold-rolled sheet having a thickness of 0.30 mm. Heat was applied to the silicon steel being rolled between the two cold-rolling stands so that the silicon steel were heat-treated at 200° C. for 3 minutes. The resultant cold-rolled sheet was then decarburization annealed at a temperature of 840° C. for 3 minutes in a wet hydrogen gas. Next, magnesium oxide was applied to the sheet, which was then dried. Final annealing was carried out at 1200° C. for 20 hours. The resultant final product had a normal secondary recrystallized structure free of streaks and had a high $B_8$ value of 1.94 T.

EXAMPLE 2

A silicon steel containing 0.055% C, 3.10% Si, 0.07% Mn, 0.025% S, 0.030% acid-soluble aluminum, and 0.008% total N was heated to 1420° C. and then was subjected to the following types of hot-rolling, each type being carried out in 3 passes so that a 2.2 mm thick hot-rolled steel sheet was produced.

A roll-cross type of hot-rolling was carried out by crosswisely arranging the axial lines of the top working roll and the bottom working roll in the case of the second pass at an intersection angle of 1.5° as seen in a horizontal plane.

An unequal circumeferential-speed type of hot-rolling was carried out by differentiating the number of rotations of the top working roll from that of the bottom working roll, in the case of the third pass, by a value of 25%. The first pass was carried out by means of conventional hot-rolling. The temperature of silicon steel was approximately 1130° C. during the second pass and approximately 850° C. during third pass. The resultant hot-rolled sheet was precipitation annealed by heating it to 1120° C. and holding the temperature for 2 minutes. The hot-rolled and precipitation annealed sheet was cold-rolled in ten passes so as to obtain a cold-rolled sheet having a thickness of 0.25 mm. Heat was applied to the silicon steel being rolled between the two cold-rolling stands so that the silicon steel was heat-treated at 200° C. for 3 minutes. The resultant cold-rolled sheet was then decarburization annealed at a temperature of 840° C. for 4 minutes in a wet hydrogen gas. Next, magnesium oxide was applied to the sheet, which was then dried. Final annealing was carried out at 1200° C. for 20 hours. The resultant final product had a normal secondary recrystallized structure free of streaks and had excellent magnetic properties, i.e., a $B_8$ value of 1.94 T and a $W_{17/50}$ value of 0.92 W/kg.

We claim:

1. A process for producing a grain-oriented silicon steel strip or sheet, wherein a silicon steel slab containing from 2.0 to 4.5% by weight of silicon and not more than 0.080% by weight of carbon is subjected to hot-rolling and then to cold-rolling, the cold-rolling being carried out in either one step or two steps to obtain a thickness of a final product, an intermediate annealing being carried out between the two cold rolling steps, decarburization annealing being carried out, and, after applying an annealing separator, final high-temperature annealing being carried out so as to form a {110} <001> texture, characterized in that during hot rolling said silicon slab is subjected, at a temperature range of from 850° C. to 1160° C., to at least one pass in which the axial lines of the top working roll and the bottom working roll are non parallel, and as a result of these working rolls being non parallel, the grain-oriented electromagnetic steel sheet or strip has no streaks and has a high magnetic flux density.

2. A process according to claim 1, characterized in that the intersection angle of said axial lines is at least 0.3°.

3. A process according to claim 2, characterized in that the intersection angle of said axial lines does not exceed approximately 3°.

4. A process according to claim 3, characterized in that said intersection angle is approximately 1.0°.

5. A process according to claim 1, characterized in that during a pass or passes identical to or different from the pass(es) in which the top working roll and the bottom working roll have said non parallel axial lines, the top working roll and the bottom working roll have different circumferential speeds Vu and Ve, respectively.

6. A process according to claim 5, characterized in that the circumeferential speed (Vu) of the top working roll is greater than the circumeferential speed (Ve) of the bottom working roll, and the relative circumferential speed $$V_R = Vu/Ve$$

is at least 1.05.

7. A process according to claim 6, characterized in that the circumferential speed (Ve) of the bottom working roll is greater than the circumferential speed (Vu) of the top working roll, and the relative circumferential speed $$V_R = Ve/Vu$$

is at least 1.05.

8. A process according to claim 1 or 5, characterized in that said grain-oriented electromagnetic steel strip or sheet is not more than 0.28 mm in thickness.

* * * * *